US006558501B1

(12) United States Patent
Franco

(10) Patent No.: US 6,558,501 B1
(45) Date of Patent: May 6, 2003

(54) PROCESS OF APPLICATION AND COOLING OF ADHESIVE FOR GLUEING CARTRIDGE PACKAGES AND SIMILAR

(76) Inventor: Celso Renato Junqueira Franco, Rua Pará, 270 AP. 22, CEP 01243-903-Sao Paulo, SP (BR)

( * ) Notice: Subject to any disclaimer, the term of this patent is extended or adjusted under 35 U.S.C. 154(b) by 0 days.

(21) Appl. No.: 09/914,115

(22) PCT Filed: Sep. 2, 1999

(86) PCT No.: PCT/BR99/00094

§ 371 (c)(1),
(2), (4) Date: Aug. 23, 2001

(87) PCT Pub. No.: WO00/59803

PCT Pub. Date: Oct. 12, 2000

(30) Foreign Application Priority Data

Mar. 31, 1999 (BR) ..... 9901502

(51) Int. Cl.[7] ..... C09J 5/06; B65D 5/43

(52) U.S. Cl. ..... 156/277; 156/308.4; 156/320; 229/102

(58) Field of Search ..... 83/449, 467, 476, 83/477, 484, 489, 491, 375.9, 376.3, 376.4, 376.5, 376.6, 377.4, 377.5, 377.7; 229/102; 156/155, 277, 320, 308.4

(56) References Cited

U.S. PATENT DOCUMENTS

| | | | | |
|---|---|---|---|---|
| 2,649,239 A | * | 8/1953 | Ellsworth | 206/807 |
| 4,082,873 A | | 4/1978 | Williams | |
| 4,361,236 A | | 11/1982 | Lavery | |
| 4,937,040 A | | 6/1990 | Holcomb et al. | |
| 5,531,852 A | * | 7/1996 | Walsh et al. | 156/227 |
| 6,085,903 A | * | 7/2000 | Jotcham et al. | 206/459.5 |

FOREIGN PATENT DOCUMENTS

| | | |
|---|---|---|
| EP | 474 981 | 3/1992 |

* cited by examiner

*Primary Examiner*—Richard Crispino
*Assistant Examiner*—Sing P Chan
(74) *Attorney, Agent, or Firm*—Collard & Roe, P.C.

(57) ABSTRACT

The present object concerns an innovative glueing process for cartridge paper boxes, with an application of adhesive, of the "hot-melt" type, on the lapel of the outer tab, for three-tabbed cartridge boxes, featuring a process of heating and melting over the sites of application of the adhesive, by the use of air-pistols, heated plates and other means, drying naturally at room temperature, receiving a slight compression. The sealing of the package is achieved by the use of a "window" on the main part of the package, with the application of inscriptions by an ink-jet system, or others, over the cartridge and the adhesive, fusing and spreading over the package when heated.

1 Claim, 1 Drawing Sheet

PROCESS OF APPLICATION AND COOLING OF ADHESIVE FOR GLUEING CARTRIDGE PACKAGES AND SIMILAR

CROSS REFERENCE TO RELATED APPLICATIONS

Applicant claims priority under 35 U.S.C. §119 of Brazilian Application No. PI 9901502-1 filed Mar. 31, 1999. Applicant also claims priority under 35 U.S.C. §120 of PCT/BR99/00094 filed Sep. 2, 1999. The international application under PCT article 21(2) was published in English.

The present object concerns an innovative glueing process for cartridge paper boxes, with an application of adhesive, of the "hot melt type", on the lapel of the outer tab, for three tabbed cartridge boxes, featuring a process of heating and melting over the sites of application of the adhesive, by the use of air-pistols, heated plates and other means, drying naturally at room temperature, receiving a slight compression.

The sealing of the package is achieved by the use of a "window" on the main part of the package, with the application of inscriptions by an ink-jet system, or others, over the cartridge and the adhesive, fusing and spreading over the package when heated.

The object as issue is meant to forbid the violation of the cartridge paper PACKAGES of medicines, avoiding or hindering frauds of the health-care system, by the use of a glueing process with hot-melt adhesive.

The current models of cartridges have three tabs, while the present proposal to seal them is the application of a drop of hot-melt adhesive (hot glue) in their (smaller) inner tabs, with the placement of a outer safety seal. Another is the alteration made to the cartridges with four tabs, applying a drop or steak of adhesive in the inner tab.

In the first option, the adhesive applied would be set directly in the shaper and sealer of cartridges within the manufacturer's laboratories, with some alterations being made.

In the second option, many changes in the equipment would be necessary.

The process under discussion has the aim of solving these problems, with a quick, suitable and cheap solution, allied to the proper safety, with the application of hot-melt adhesive in the three-tabled cartridges, in the lapel of the outer tab the one that closes up the package, going into its main part. In the laboratory: all the current process remains the same, and after the sealers will be included a system of heating and melting of the adhesive (which will stick from then on), with the material cooling at the room temperature, after a few seconds, by a slight compression.

In this fashion, sealing the cartridge, and as a complement of the process, to avoid violations, a "window" may be left, that is, a small cut in the cartridge to show the glueing. Over this "window", lettering would be applied, with safety warnings or ink-jet applications, or thermoplastic adhesives that would be fused if heat was to be applied to open the cartridge PACKAGES.

BRIEF DESCRIPTION OF THE DRAWINGS

For a perfect understanding and visualisation of the PROCESS OF APPLICATION AND COOLING OF ADHESIVE FOR GLUEING CARTRIDGE PACKAGES AND SIMILAR, under discussion, the following illustrative drawings are presented, where.

DETAILED DESCRIPTION OF THE MODEL

Figure 1:
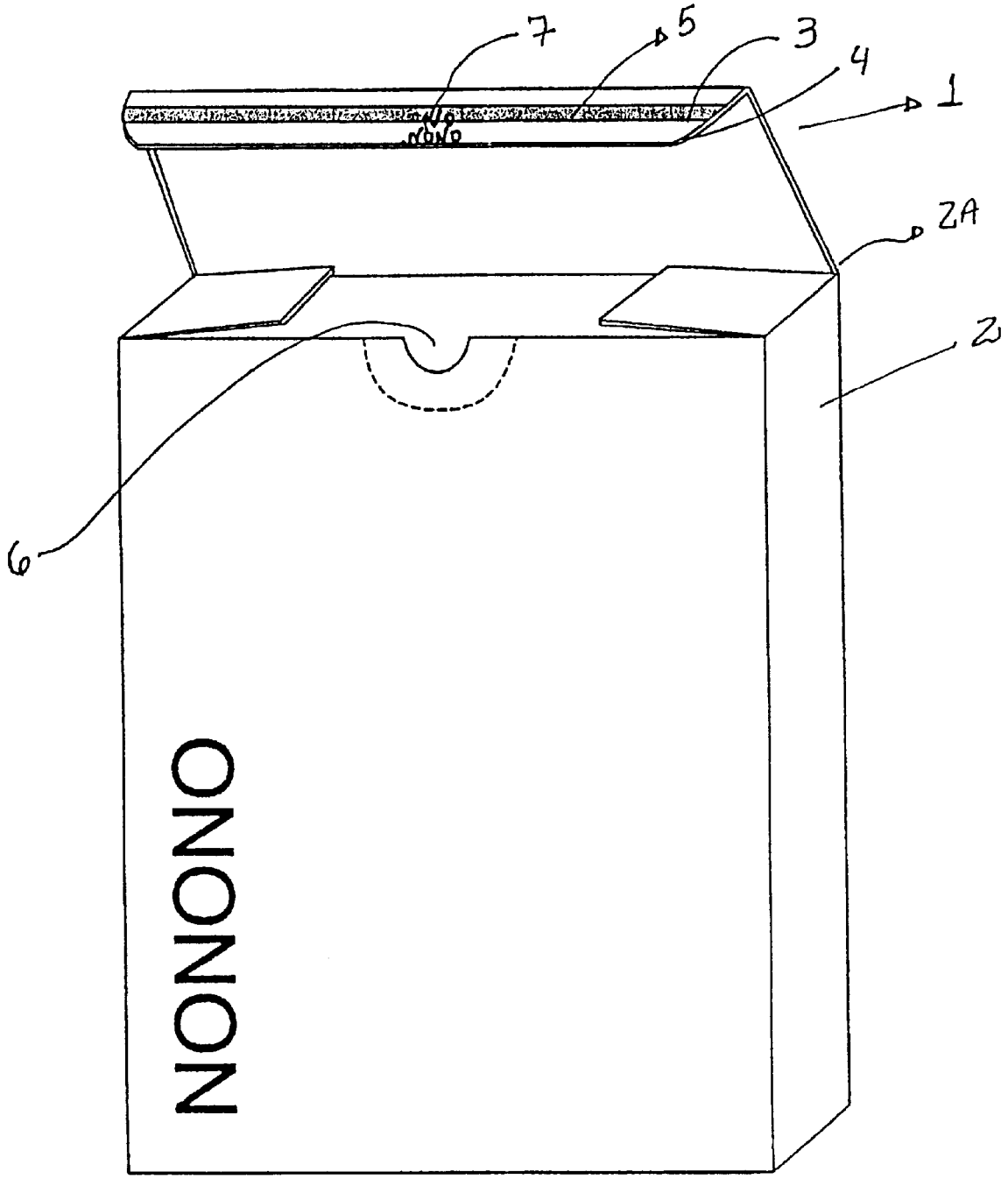
FIG. 1—shows a perspective view of a cartridge-paper package with a section of adhesive applied over the lapel of the outer tab.

According to the drawing, and in all details, the PROCESS OF APPLICATION AND COOLING OF ADHESIVE FOR GLUEING CARTRIDGE PACKAGES AND SIMILAR, under discussion, is characterised by featuring a glueing process (1), for packages of cartridge paper (2) having an application of adhesive of the "hot-melt" type (3) in the lapel of the outer tab (4), for three-tabbed cartridges (2A), featuring also a process for heating and melting (5) over the sites of application of the adhesive, by hot-air pistols, heated plates, and other means (5A), being cooled and cemented, afterwards, by a slight compression also granting inviolability of the cartridge by the use of a "window" (6) in the main part of the package (2) with the application of lettering and inscriptions by a ink-jet system and others (7) over the cartridge and the adhesive (3), fusing when heated, to spread over the package (2).

For the advantages it offers, and for showing truly innovative characteristics, the PROCESS OF APPLICATION AND COOLING OF ADHESIVE FOR GLUEING CARTRIDGE PACKAGES AND SIMILAR, gathers the necessary conditions to deserve the Privilege of Patent of Invention.

What is claimed is:

1. A process for application and cooling of adhesive for glueing cartridge packages comprising the steps of:

applying hot melt adhesive to a lapel of an outer tab of a three-tabbed cartridge package;

heating and melting said adhesive via hot air pistols or heating plates;

lightly compressing said lapel onto a main part of the cartridge package while said adhesive is naturally cooling and cementing, wherein said adhesive is viewed through a window in a main part of the cartridge package after said lapel is adhered to said main part of the cartridge package; and applying lettering or inscriptions with an ink-jet system over the cartridge package and adhesive on said lapel in a region viewed through said window, wherein said inscriptions fuse and spread over the cartridge package if heat is applied to open the cartridge package.

* * * * *